US007690232B2

(12) United States Patent
Klein et al.

(10) Patent No.: US 7,690,232 B2
(45) Date of Patent: Apr. 6, 2010

(54) LOCKING DEVICE WITH A LOCKING CYLINDER AND A KEY

(75) Inventors: Helmut Klein, Velbert (DE); Matthias Habecke, Hattingen (DE); Dirk Jacob, Heiligenhaus (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 11/991,616

(22) PCT Filed: Aug. 12, 2006

(86) PCT No.: PCT/EP2006/008011

§ 371 (c)(1),
(2), (4) Date: Jul. 21, 2008

(87) PCT Pub. No.: WO2007/028484

PCT Pub. Date: Mar. 15, 2007

(65) Prior Publication Data

US 2009/0025442 A1 Jan. 29, 2009

(30) Foreign Application Priority Data

Sep. 7, 2005 (DE) ..... 10 2005 042 617

(51) Int. Cl.
*E05B 19/06* (2006.01)
*E05B 29/04* (2006.01)

(52) U.S. Cl. ..... 70/409; 70/492

(58) Field of Classification Search ..... 70/377, 70/376, 392, 365, 366, 358, 409, 492, 495, 70/494, 405–407
See application file for complete search history.

(56) References Cited

U.S. PATENT DOCUMENTS

| | | | | | |
|---|---|---|---|---|---|
| 2,035,181 | A | * | 3/1936 | Molinare | 70/358 |
| 2,039,126 | A | * | 4/1936 | Svoboda | 70/358 |
| 2,123,940 | A | | 7/1938 | Gray | |
| 3,035,433 | A | * | 5/1962 | Testa | 70/495 |
| 4,148,201 | A | * | 4/1979 | Miyamae et al. | 70/358 |
| 4,357,815 | A | * | 11/1982 | Kleefeldt et al. | 70/337 |

(Continued)

FOREIGN PATENT DOCUMENTS

| | | |
|---|---|---|
| DE | 299 23 496 | 12/2000 |

(Continued)

*Primary Examiner*—Lloyd A Gall
(74) *Attorney, Agent, or Firm*—Friedrich Kueffner

(57) ABSTRACT

A locking device having a locking cylinder and a key. The locking cylinder includes a cylinder core with tumblers in a cylinder core, which is rotatably mounted in a cylinder housing. Standard coding for the key is produced by a step with longitudinal profiling on at least one flat side of the edge profile of the key, said step being associated with a counter step on the tumbler. In addition to the standard coding produced by step and counter step, the key has at least one set of beveled edge coding in a corner section of the edge profile. The beveled edged coding consists of recesses in the form of beveled cuts in the corresponding corner sections of the edge profile, relative to which are provided counter touching points in the corresponding tumbler. In a section of the key shaft, either the standard coding or beveled edge coding can optionally be used, thereby considerably increasing the diversity of the locking device while retaining the space-saving design.

18 Claims, 9 Drawing Sheets

U.S. PATENT DOCUMENTS

| | | | | |
|---|---|---|---|---|
| 4,516,416 | A * | 5/1985 | Prunbauer et al. | 70/276 |
| 4,612,787 | A * | 9/1986 | Prunbauer et al. | 70/358 |
| 4,750,342 | A | 6/1988 | Nakai | |
| 5,182,929 | A * | 2/1993 | Myers | 70/337 |
| 5,490,405 | A * | 2/1996 | Ramo et al. | 70/366 |
| 6,526,791 | B2 * | 3/2003 | Shvarts | 70/419 |
| 6,591,645 | B1 * | 7/2003 | Wittwer | 70/366 |
| 6,799,447 | B2 * | 10/2004 | Mielonen et al. | 70/366 |
| 7,159,424 | B2 * | 1/2007 | Widen | 70/409 |
| 7,240,525 | B2 * | 7/2007 | Sevillano Gil | 70/340 |
| 7,424,815 | B1 * | 9/2008 | Pagnoncelli | 70/340 |
| 2005/0183481 | A1 * | 8/2005 | Lee | 70/358 |
| 2006/0000251 | A1 * | 1/2006 | Ceron et al. | 70/492 |

FOREIGN PATENT DOCUMENTS

| | | |
|---|---|---|
| DE | 199 44 070 | 4/2001 |
| EP | 0 267 316 | 5/1988 |

* cited by examiner

LOCKING DEVICE WITH A LOCKING CYLINDER AND A KEY

BACKGROUND OF THE INVENTION

The invention concerns a lock device. On a flat side of the edge profile, a profiled shoulder extends in the longitudinal direction of the key. This profiled shoulder produces a family of scanning points for a standard coding on the key by virtue of the course of its profile. At least some individual tumblers are provided with a cooperating shoulder, which, when the key is inserted, is supported on a well-defined location of this shoulder. These cooperating shoulders function as cooperating scanning points for the standard coding of the key, and for this reason they are to be called "standard tumblers". The family of all standard tumblers located in a cylinder core produces with its cooperating shoulders the complementary standard countercoding to the associated key.

A lock device of this type is disclosed by DE 199 44 070 C2. In that lock device, the coding of the key consists of a coding groove that extends in the longitudinal direction of the key. The corresponding tumblers have projections that serve as scanning points, and, when the key is inserted, these projections fit into a certain cross section of the coding groove. The range of variation for the coding of the key and countercoding in the associated package of tumblers can be increased with a given height of the increments between successive code points only by increasing the length or the width of the key. With a longer key, a larger number of tumblers can be positioned in the cylinder core. With a wider key, the number of increments for coding the key can be increased. Both of these measures have the disadvantage that they increase the overall height or overall length of the lock device as a whole. An increase in the dimensions of the lock device is undesirable. Furthermore, the previously known lock device has the disadvantage that it can be forced open relatively easily with picking tools.

EP 0 267 316 A1 describes a lock device of a different type, in which the bit of the key has a polygonal cross section. In isolated positions that are circumferentially and axially separated from each other, notches of different depths are located on the edges of the key bit and are used for the coding of tumbler pins. In the area of a cross section of the key bit, the only pin tumbler that can engage in this area is one which is oriented in a certain direction and is associated with the notch located in that area and cannot be replaced by other pin tumblers that are oriented in a different direction and are spring-loaded. At the tip of the key shaft, bevels are provided in the lateral surfaces between the edges, but these only serve the purpose of raising the tumbler pins when the key is inserted.

SUMMARY OF THE INVENTION

The objective of the invention is to develop a space-saving lock device, which has a high degree of safety with respect to being forced open.

In the invention, at least one corner region of the edge profile of the key is used to produce an additional beveled coding in the key by means of bevel cuts. Unauthorized persons who want to force open the lock cylinder do not know whether the usual standard coding or the beveled coding mentioned in the claim is present in a certain section of the key and in which direction this beveled coding acts. In each tumbler of a family of tumblers that is located in a cylinder core, a standard tumbler can be optionally located at a certain scanning point, and this standard tumbler can then cooperate with the standard coding of the key, or a beveled tumbler can be positioned there, and this beveled tumbler is supported on the beveled coding. This alone makes it possible to increase the range of variation of the lock device of the invention. If we consider that there are many corner regions in the edge profile of the key that have different beveled coding, the range of variation can be further increased by variable selection of the beveled tumblers in each axial section of the key bit. In this regard, neither the size of the key nor the size of the lock device needs to be increased. On the contrary, the bevel cuts in the corner regions reduce the cross section of the key bit.

The standard coding and the beveled coding in the various corner regions of the key extend side by side in the longitudinal direction of the key, which is why the aforementioned multiple scanning points in a cross section of the key can be used as desired. In accordance with another variant, at the scanning point of a specific beveled coding, the scanning direction of the associated beveled tumbler can be positioned differently. The scanning direction can be positioned at any desired angle, e.g., parallel to the scanning direction of the standard tumbler, perpendicular to it, or at any desired inclination to it.

This makes the lock cylinder of the lock device of the invention impenetrable to unauthorized persons and thus more difficult to force open. The beveled scanning points of the beveled coding on the beveled tumblers conceal in the keyway the other standard or beveled tumblers located behind them. As a result, it is practically impossible to force open the key with picking tools.

The invention is explained with reference to the specific embodiments illustrated in the drawings.

DETAILED DESCRIPTION OF THE INVENTION

Figure 3:
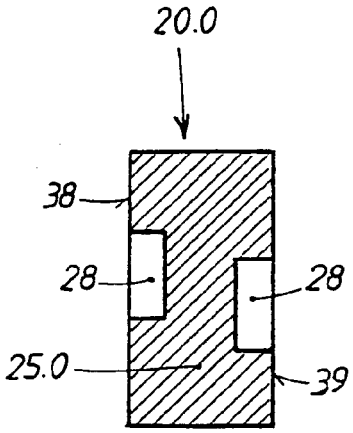
FIG. 3 Prior Art
FIG. 3 shows a prior-art key cross section similar to that described in DE 199 44 070 C2, which was cited earlier.
Figure 4:
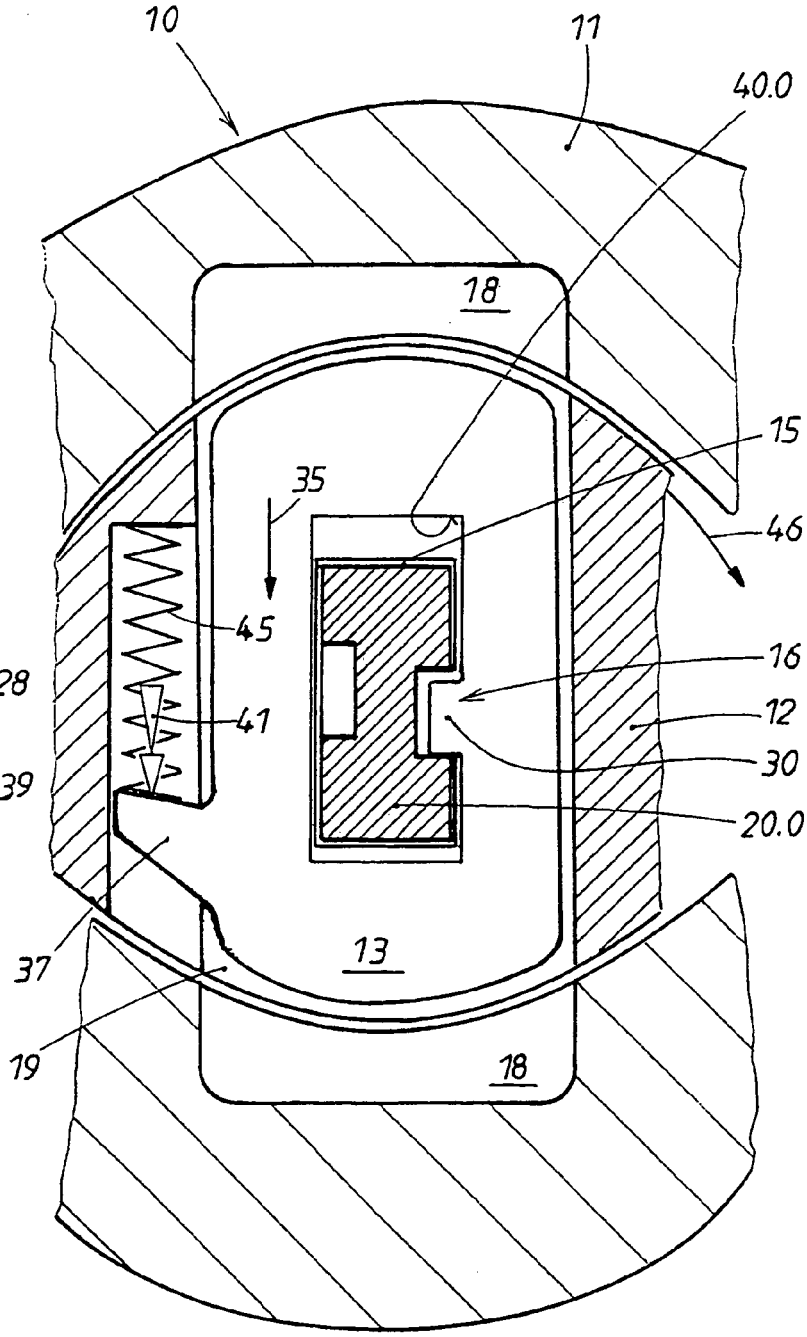
FIG. 4 Prior Art
FIG. 4 shows a lock cylinder that belongs to the key of FIG. 3, with the key inserted. The design principle of the lock cylinder of the invention is apparent in this lock cylinder.

The previously known lock device shown in FIGS. 3 and 4 shows the design that can be found analogously in the lock device of the invention but differs from it in certain important aspects, which will be explained in detail below. First of all, we shall concern ourselves with the basic design of a lock device of this type, which also applies to the invention.

A cylinder core 12 is rotatably supported in a stationary cylinder housing 11. The previously known key 20.0 has an edge profile 25.0 in the form of a rectangle and can be inserted into an axial keyway 15 of the cylinder core 12. The cylinder core 12 has diametrical chambers 19, in which tumblers 13 are located, which can move transversely to the axis of the cylinder. In the example illustrated here, the tumblers 13 are spring-loaded in the direction of the arrow 41 by a spring 45 and, when the key 20.0 is not inserted, enter one of several blocking channels 18 of the cylinder housing 11. The spring loading 41 acts on a lateral projection 37 of the tumbler 13. Rotation of the cylinder core 12 is then blocked.

With the proper key 20.0 inserted, on the other hand, the tumblers 13 are sorted onto the cross section of the cylinder core, as shown in FIG. 4. The cylinder core 12 can then be turned by the key 20.0 in the direction of the arrow 46. In the present case, a longitudinally profiled groove 28 is located in each of the two broad sides 38, 39 of the key 20.0 and extends in the longitudinal direction of the key. The course of the profiling produces scanning points on the key 20.0, which produce a "standard coding". Instead of a groove 28, it is also possible to use a longitudinally profiled shoulder. Each of the numerous tumblers 13 in the cylinder core 12 is provided with a projection 30, whose position and/or width produces a complementary "standard countercoding 16" for the key 20.0. The tumbler 13 has a window 40.0 in which the projection 30 is formed as an integral part of the tumbler. Instead of a projection 30, the tumbler 13 could have a cooperating shoulder, which rests against the previously mentioned shoulder of the cylinder core when the key is inserted. The family of tumblers 13 producing the standard countercoding will be referred to hereinafter as "standard tumblers". The aforesaid sorting of the tumblers 13 occurs when the projections 30 fit into one of the grooves 28.

Figures 2A, 2B:
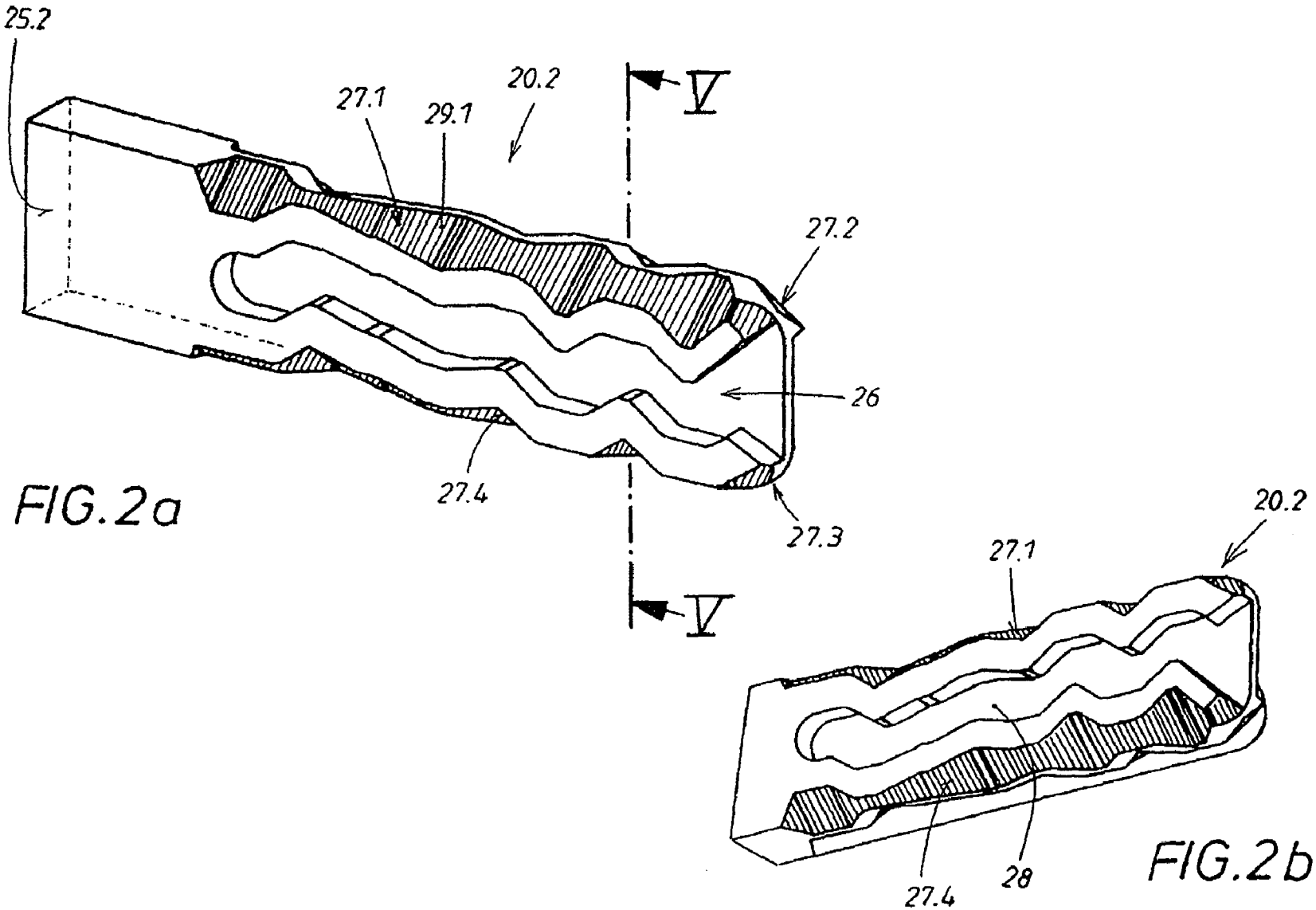
FIGS. 2*a* and 2*b* show two perspective views of a second embodiment of the key of the invention in two different viewing directions.
Figure 2C:
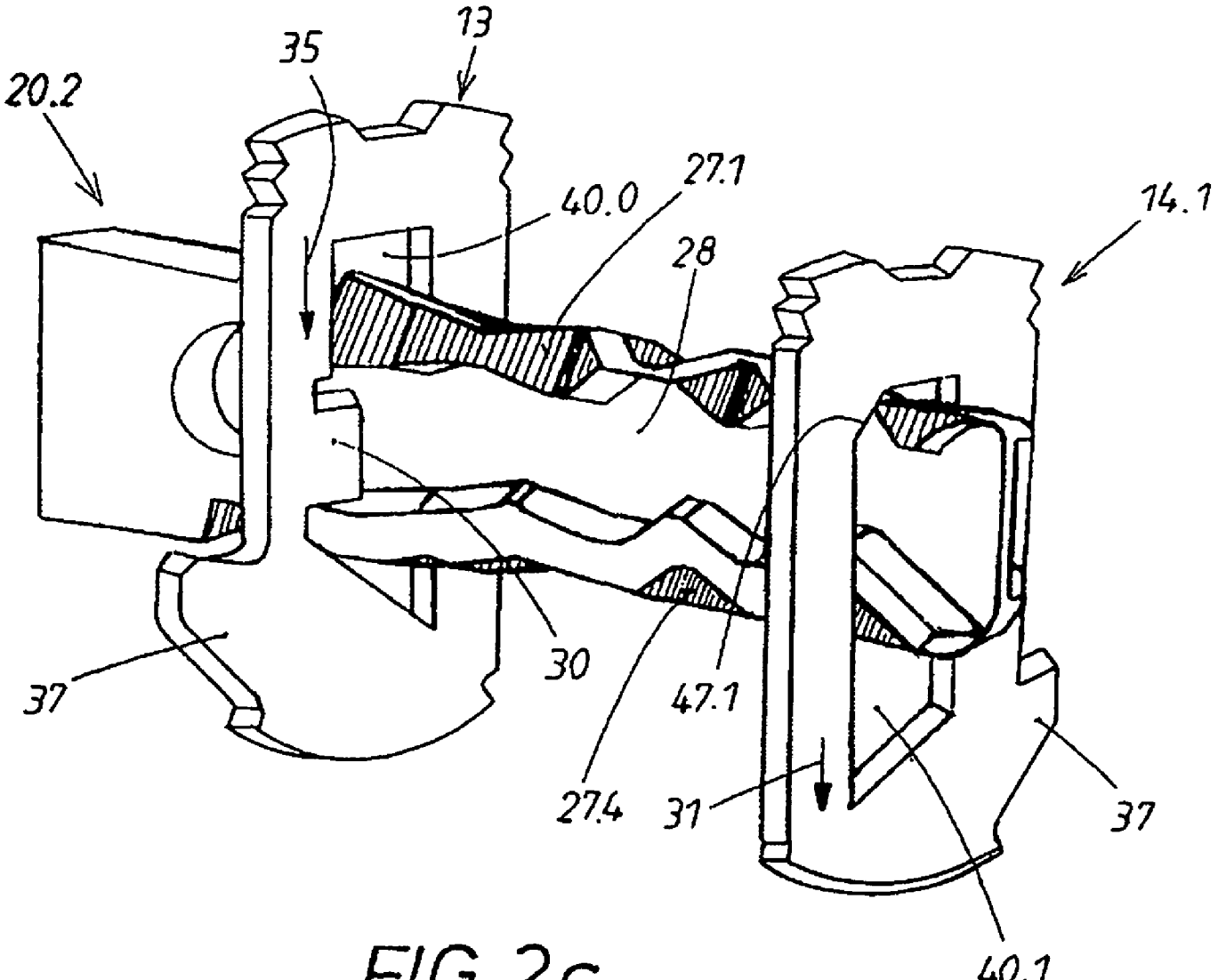
FIG. 2*c* shows a perspective drawing, which is analogous to FIG. 2*a*, of the key, which is acted upon by two different types of tumblers of a lock cylinder, which is shown in FIG. 4.
Figure 5:
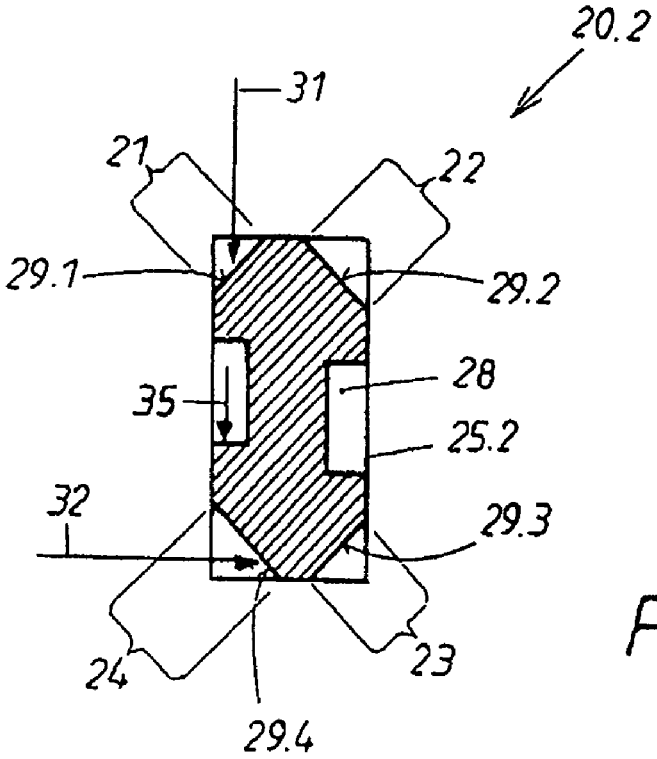
FIG. 5 shows a cross section through the bit of the key shown in FIG. 2*a*, along sectional plane V—•—V in FIG. 2*a*.
Figure 6:
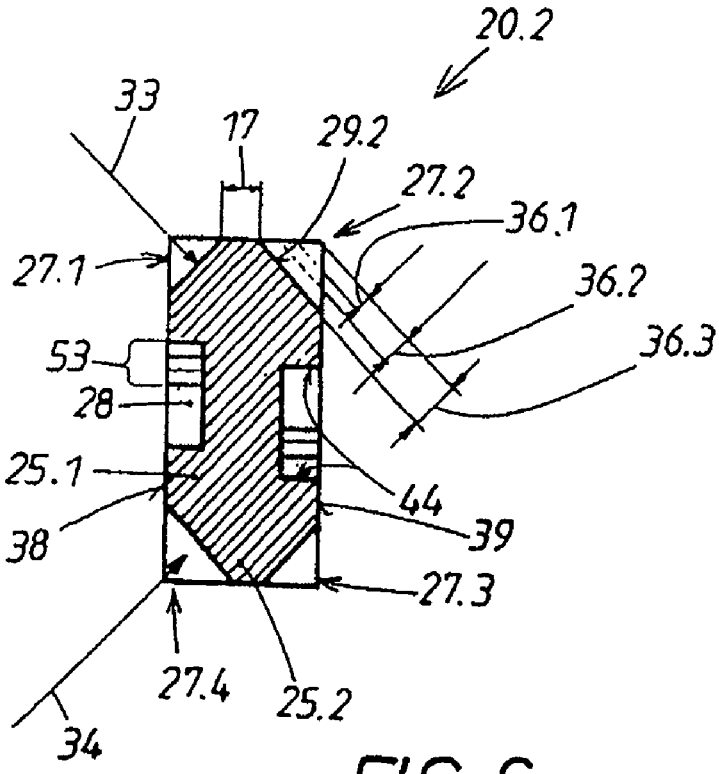
FIG. 6 shows the same cross section as FIG. 5 to illustrate different variants of the coding.

A significant difference to be found in the lock cylinder of the invention is that first the key illustrated in FIG. 5 and FIG. 6 is provided with additional coding in the same cross section, as will be explained in greater detail above all with reference to the key shown in FIGS. 2*a* to 2*c*.

As shown in FIGS. 5 and 6, the key 20.2 has an edge profile 25.2, which is a rectangular profile and thus has four corner regions. In the invention, these corner regions are provided with bevel cuts 29.1 to 29.4 with varying depth of the bevel cut, which produce continuous profiled corner strips 21 to 24. At the two opposite narrow sides of the rectangular profile 25.1, there is a lateral distance 17 between the two adjacent beveled codings 27.1 and 27.2 at one end, and 27.3 and 27.4 at the other end. These corner strips 21 to 24, which extend in the longitudinal direction of the key, produce four beveled codings, which from case to case are formed differently from one another. This results in a very great number of possible variations.

A first possible variation for the interrogation of a predetermined cross section, e.g., the one shown in FIG. 5, yields six alternative possibilities. As FIG. 2*c* shows, the standard tumbler 13 described above can optionally act on the left or the right groove 28; in FIG. 10, it is shown fitting into a right groove of the edge profile 25.2. Due to its spring loading 41, the standard tumbler 13 has a scanning direction illustrated by the motion arrow 35 in FIGS. 4, 2*c*, 5, and 10. As shown in FIG. 2*c*, however, a differently designed tumbler 14.1 is also present. The tumbler 14.1 is shown in a top view in FIG. 7, from which the following special design is apparent.

Figure 7C:
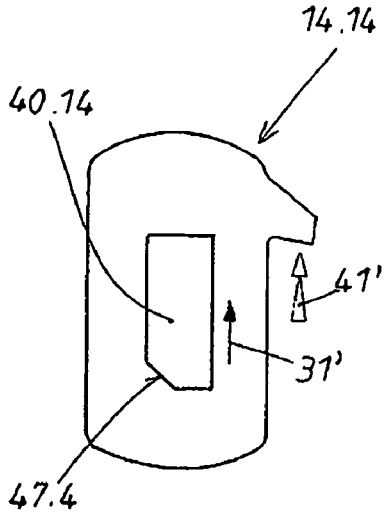
FIGS. 7*a*-7*c* show three variants of FIG. 7. The three drawings show three tumblers, each of which acts in an analogous way on one of the three beveled codings.
Figure 7B:
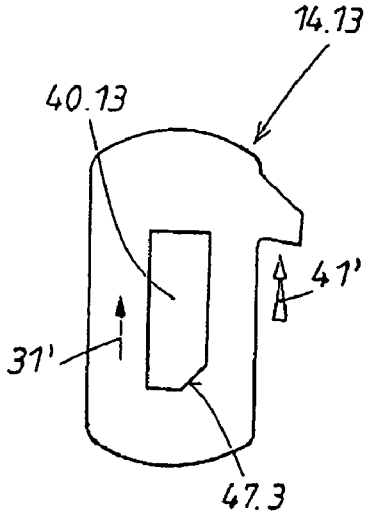
Figure 7A:
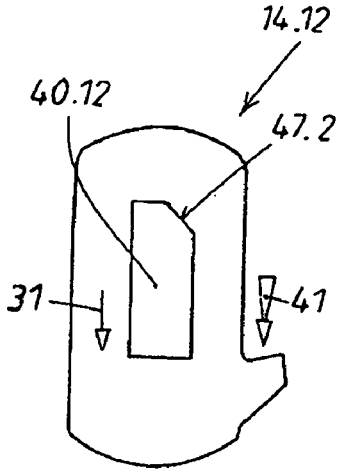
Figure 7:
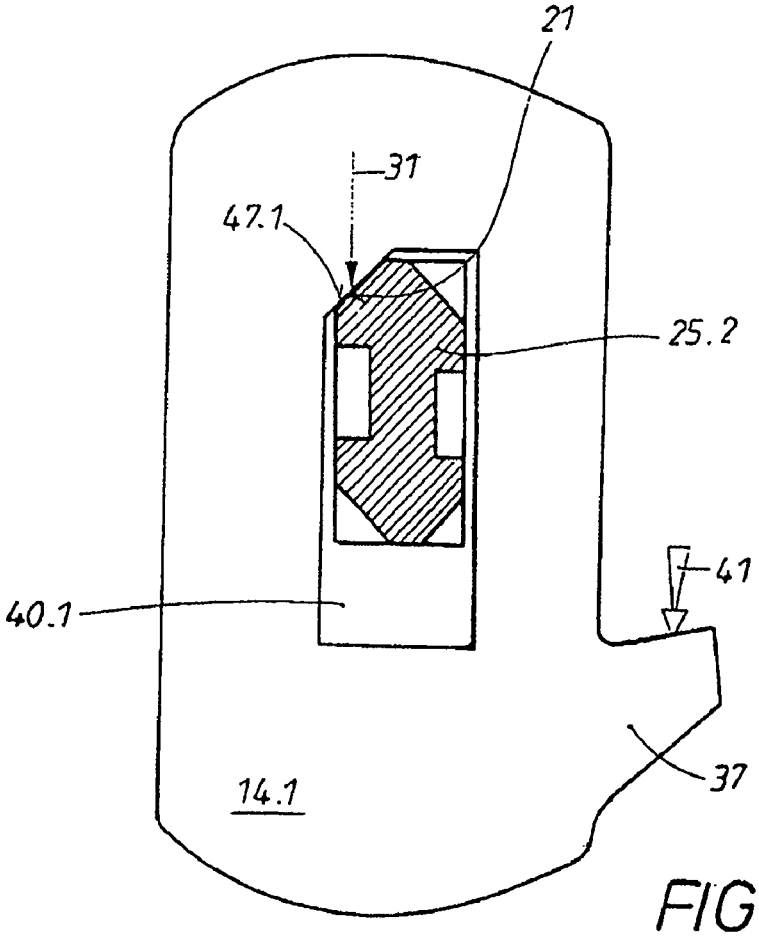
FIGS. 7 to 9 show three different possibilities for arranging the beveled tumblers of the invention, in the same cross section as FIG. 5. All three tumblers always act on the same beveled coding.

The tumbler also has a window 40.1, which has an oblique cooperating scanning point 47.1, which, when the key is inserted, acts on the first corner strip 21 in the illustrated cross section of FIGS. 5 and 7. The corner strip produces the aforementioned first beveled coding 27.1. Therefore, this tumbler 14.1 can be called a "beveled tumbler". Due to the direction of the spring loading 41 indicated by the arrow 41, which here, too, acts on a lateral projection 37 of the tumbler 14.1, a scanning direction of the tumbler 14.1 is obtained, which is indicated by the motion arrow 31 and in this case runs parallel to the scanning direction 35 of the standard tumbler 13, as illustrated in FIGS. 4 and 7.

Alternatively, similar beveled tumblers could also act on the three other coded corner strips 22 to 24 of the edge profile 25.2 of the key 20.2 as shown in the cross section of FIG. 5. FIGS. 7*a* to 7*c* show three beveled tumblers 14.12 to 14.14, which differ from FIG. 7 only in that the oblique cooperating scanning points 47.2 to 47.4 in their windows 40.12 to 40.14 are in different positions. In this regard, in FIGS. 7*b* and 7*c*, it is sufficient to reverse the direction of spring loading 41' from that shown in FIG. 7, so that parallel but oppositely directed scanning directions 31' are obtained in FIGS. 7*b* and 7*c*.

Figure 10:
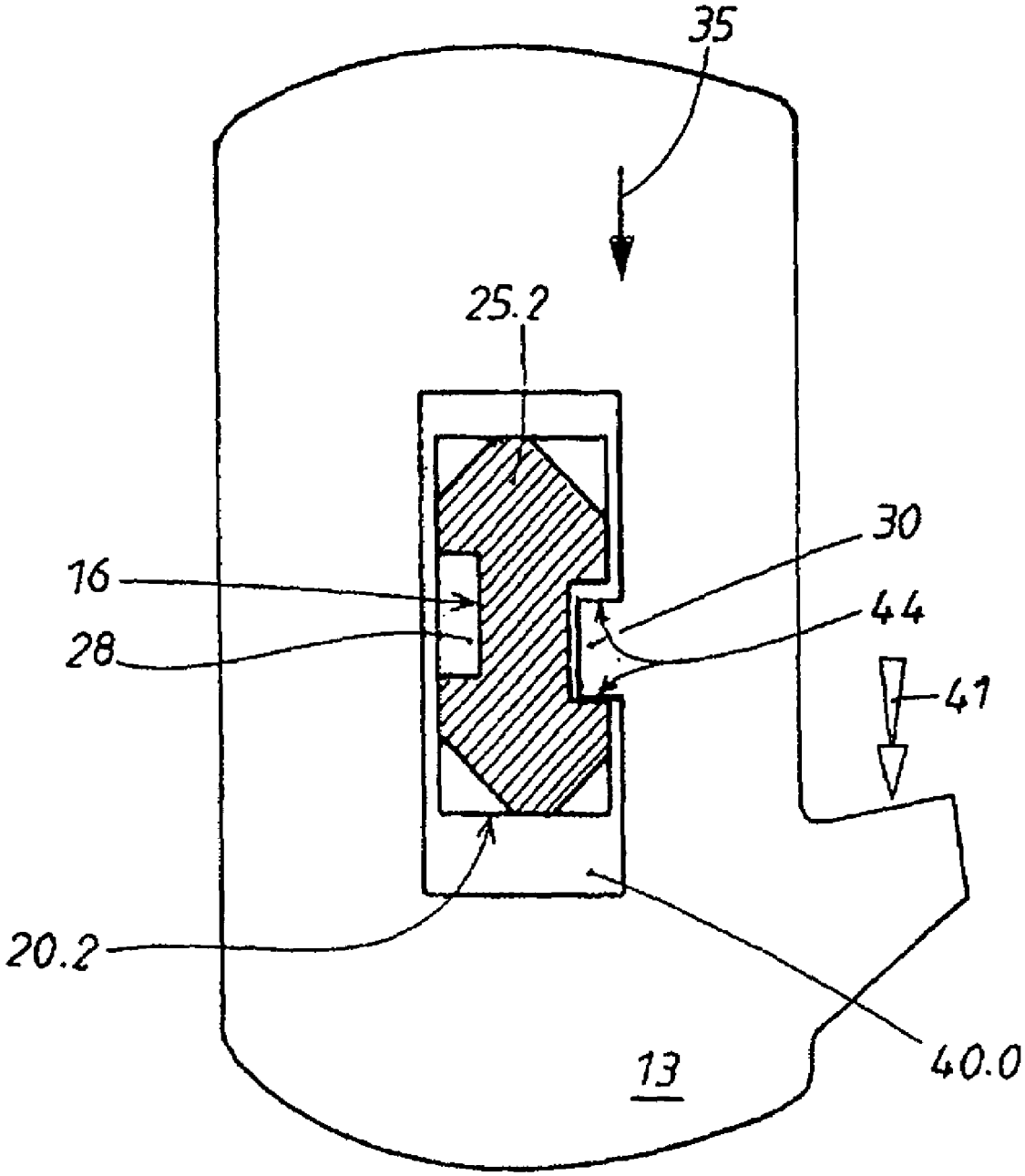
FIG. 10 again shows the same cross section as FIG. 5 but in this case with the arrangement of a standard tumbler in this cross section of the key bit.

As has already been noted, FIG. 10 shows a standard tumbler 13, which interacts in the usual way with the groove 28 of the key 20.2 and produces a cooperating scanning point of the standard countercoding 16 in the same key profile. As will be explained in greater detail with reference to FIG. 1*b*, the profiled course of the groove 28 for its part comprises several increments, and this produces the standard coding 53 that is illustrated schematically in FIG. 6. If we disregard the possible variation of different increments of the standard coding 53 and the variation of the depths of cut of the beveled coding 27.1 to 27.4 of FIG. 6 and we do not take into consideration the variants of the scanning possibilities, which will be explained in greater detail below, the following tumblers can act at one and the same place in the cross section of the key 20.2, namely, 13, 14.1, 14.12, 14.13, and 14.14. These tumblers are optionally located in one of the chambers 19 of the cylinder core 12 that is positioned in this location of the inserted key 20.2.

Another variant consists in the aforementioned variation of the depth of cut 36.1 to 36.3 of the beveled coding 27.1 to 27.4 at each of the four beveled codings 47.1 to 47.4 in a predetermined cross section of the key 20.2 apparent from FIG. 6. According to FIG. 6, the bevel cut 29.2 of the second beveled coding 27.2, for example, can optionally assume different depths of cut 36.1 to 36.3, thereby resulting in variation of the coding. It goes without saying that it would also be possible to use more than three depths of cut in the illustrated beveled coding 27.1 to 27.4. Naturally, the coding can be varied in this way not only in the corner strip 22 of FIG. 5 but also in the other three corner strips 21, 23, and 24.

Figure 8:
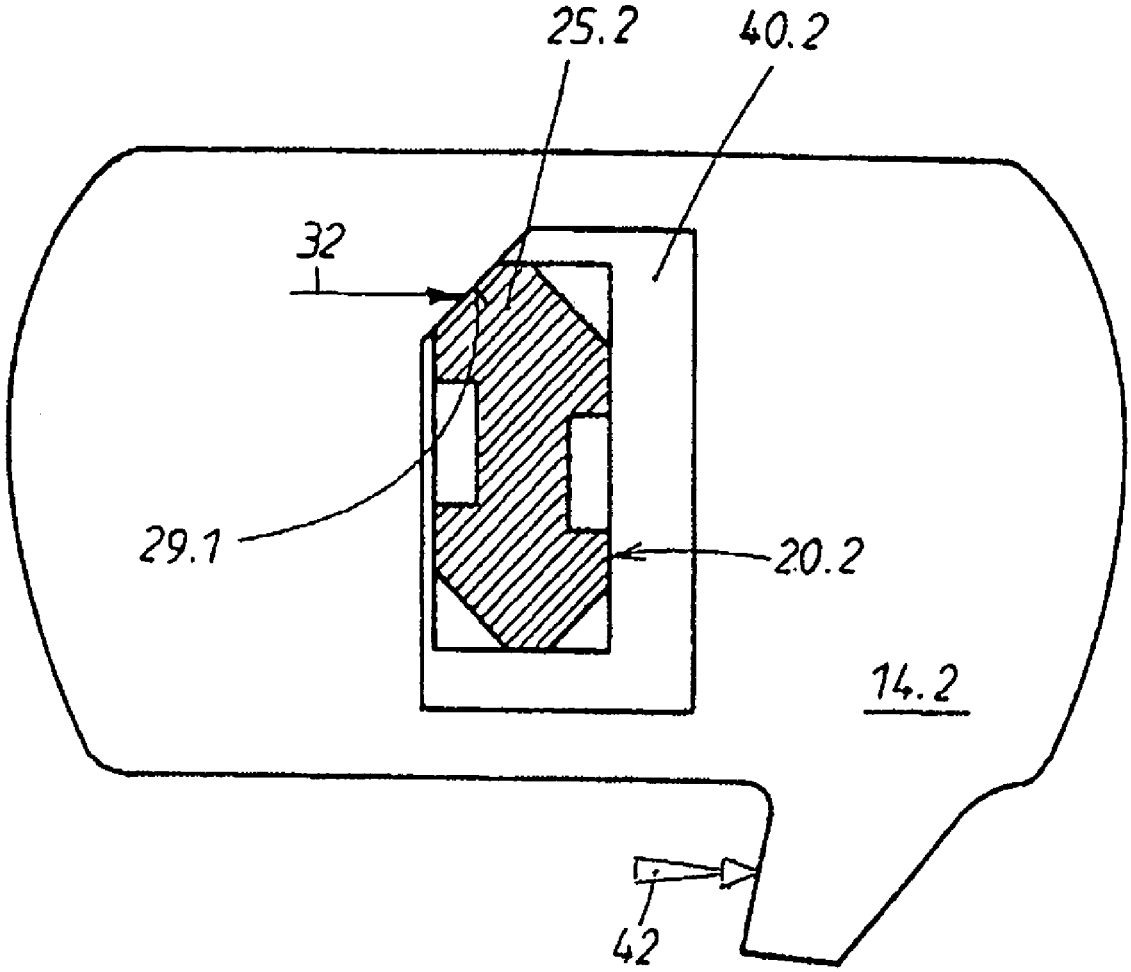
Figure 9:
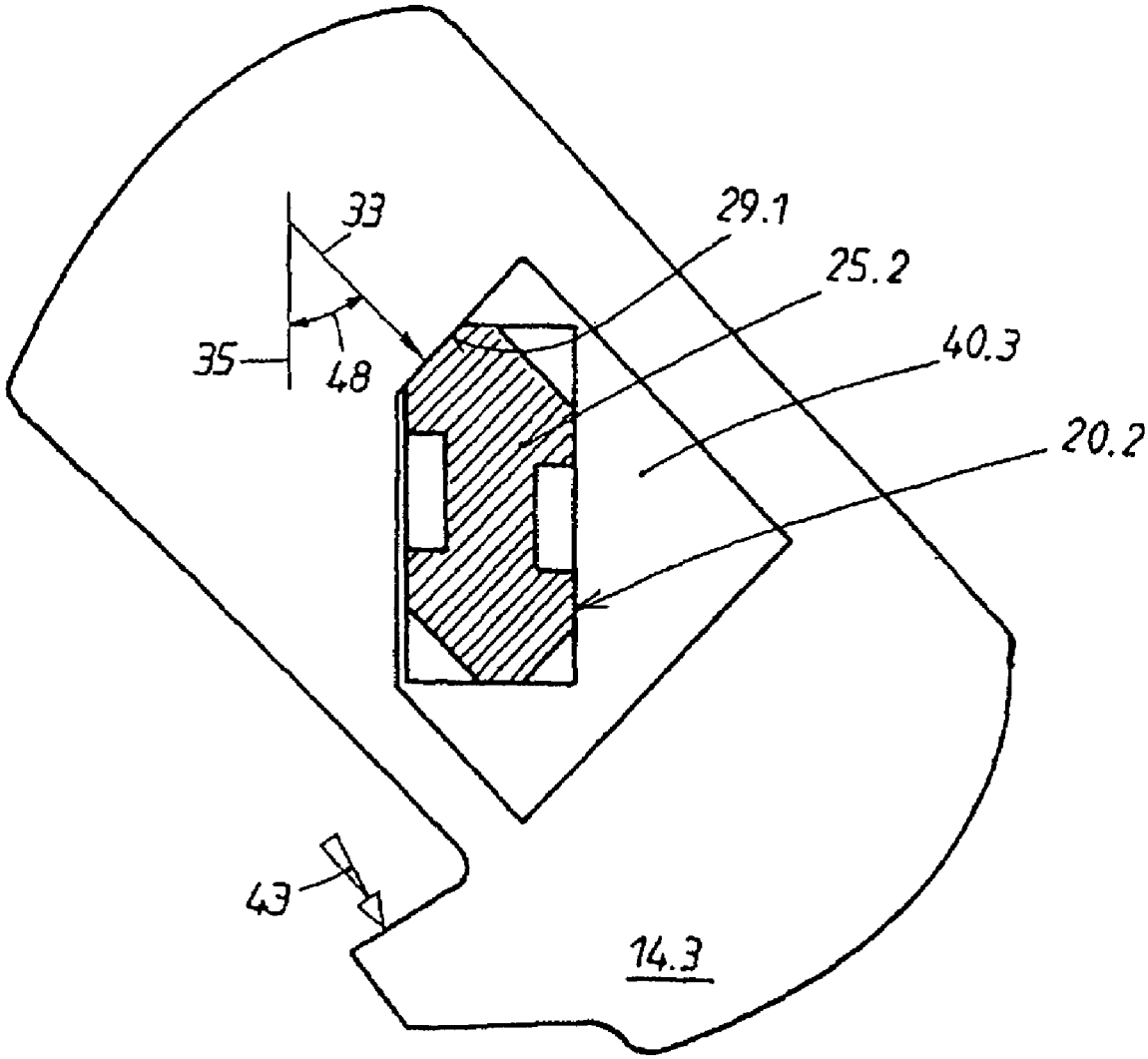

Another variation in the design of the lock device of the invention is obtained if the scanning direction 31 to 33 of the beveled tumblers 14.1 to 14.3 according to FIGS. 7, 8, and 9 is oriented in different ways with respect to the scanning direction 35 of the standard tumbler 13, as shown in FIGS. 9 and 10. In each of FIGS. 7 to 9, only the first bevel cut coding 29.1 is considered and not the other three beveled codings 27.2 to 27.4.

In FIG. 7, the scanning direction 31 of the beveled tumbler 14.1 is parallel to the scanning direction 35 of the standard tumbler 13; the second scanning direction 32 of the second beveled tumbler 14.2 is perpendicular to the scanning direction 35 of the standard tumbler 13; and the third scanning direction 33 of the third beveled tumbler 14.3 is at an oblique angle 48 to the scanning direction 35 of the standard tumbler 13. It goes without saying that the angle 48 itself could be chosen with a variety of values, which further increases the range of angular variation. The different scanning directions 31 to 33 arise from the different relative positions of the spring loadings (indicated by arrows 41 to 43) of the beveled tumblers 14.1 to 14.3. The scanning direction 31 to 34 according to FIGS. 6 to 9 also determines the direction of the longitudinal movement of the given beveled tumblers 14.1 to 14.3 in the cylinder core 12 of FIG. 4.

Apart from the given different increments in the depth of cut 36.1 to 36.3 of the beveled codings 27.1 to 27.4 and the increments of the groove 28 of the standard coding 53 relative to the projections 30 of the associated standard tumblers 13, a range of variation for the key 20.2 of the lock device of the invention is also obtained by virtue of the fact that the tumblers can be arranged in alternating order along the bit. At each cross section of the key 20.2, the five scanning directions 31 to 35 described above are obtained, as are the opposite scanning directions running in the opposite direction from 31 to 35. Except for FIGS. 7*b* and 7*c* at 31' for the beveled tumbler 14.1, the opposite scanning directions of the three other possibilities of tumblers 14.2, 14.3, and 13 are not shown. The axial sequence of these different tumblers 13 and 14.1 to 14.3 in the direction of the axis of the key can be selected in any desired way.

As was mentioned earlier, according to FIGS. 2*a* to 2*c*, all four corner regions 21 to 24 (see FIG. 5) are provided with a beveled coding 27.1 to 27.4. These four beveled codings can be designed differently from one another. In the present case, however, the diametrically opposed beveled codings, namely, 27.1 and 27.3, on the one hand, and 27.2 and 27.4, on the other hand, have the same design, so that the corresponding key 20.2 is a so-called "either-way key". An either-way key 20.2 of this type is distinguished by the fact that it can be successfully inserted in the keyway 15 of the cylinder core 12 in two positions that are 180° apart. This makes it easier to use the key.

In the present case, the standard tumbler 13 fits into the standard coding of the key with positive engagement due to the longitudinally profiled groove 28. As a result, positive guidance 44 is provided between the tumbler 13 and the key 20.2, as illustrated in FIGS. 6 and 10. The positive guidance 44 makes it possible, if necessary, to use the standard tumblers 13 without spring loading 41. Something analogous could occur with a pair of bevel cuts that enclose the edge profile 25.2 between them. This could be, for example, the beveled codings 27.1 and 27.3 or 27.2 and 27.4. These then form a matching pair of beveled codings, which could serve for the positive guidance of a common beveled tumbler. A common beveled tumbler of this type (not shown) then has a corresponding pair of cooperating scanning points, which result, for example, from the oppositely inclined cooperating scanning points 47.1 and 47.4 of FIGS. 7 and 7*c*, on the one hand, and 47.2 and 47.3 of FIGS. 7*a* and 7*b*, on the other hand.

Figures 1A, 1B:
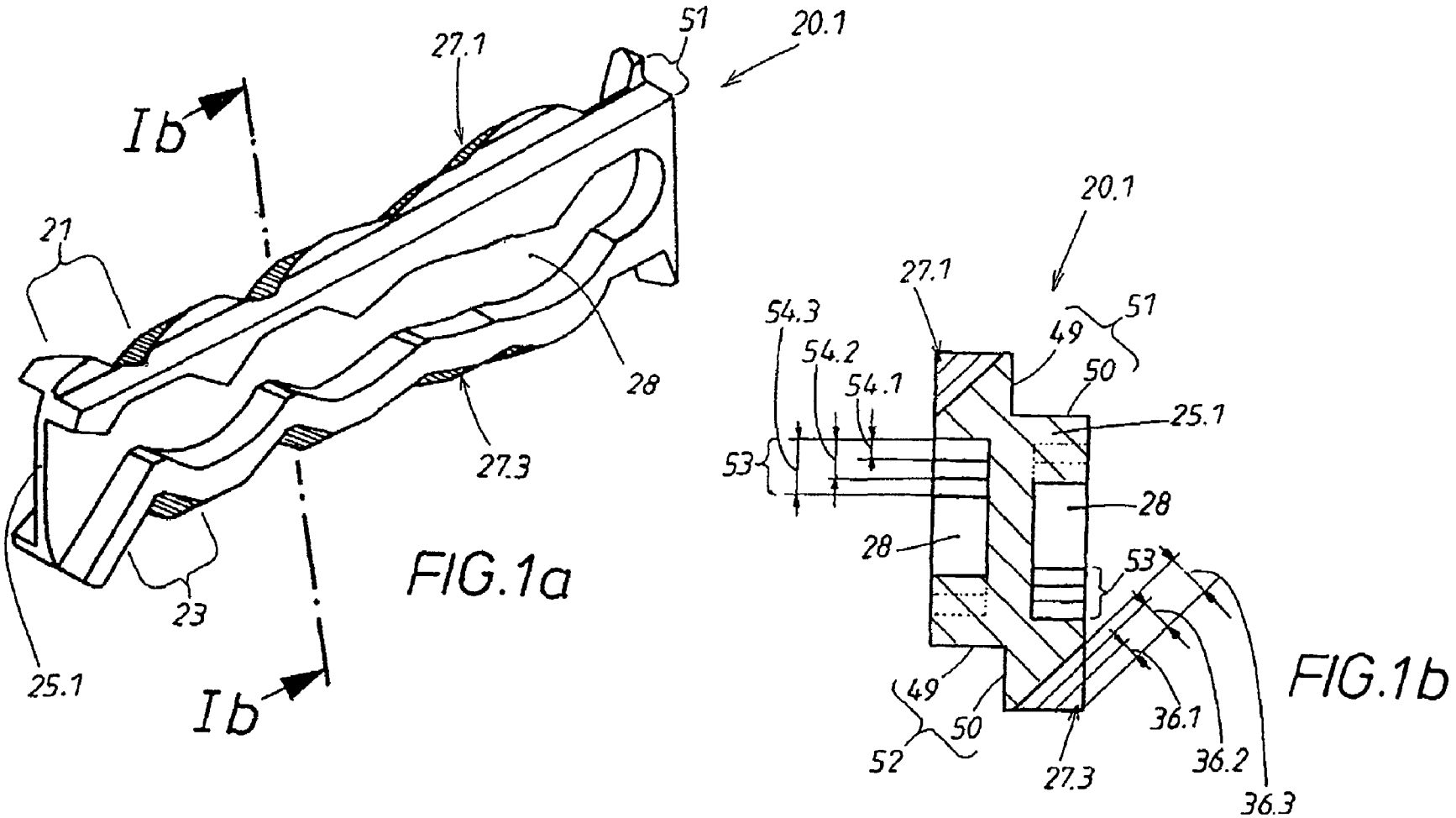
FIG. 1*a* shows a perspective view of a first embodiment of the key of the invention.
FIG. 1*b* shows a cross section through the bit of the key of FIG. 1*a*, as viewed in the direction of the sectional plane Ib—•—Ib of FIG. 1*a*.

The first embodiment of the key 20.1 of the invention in FIGS. 1*a* and 1*b* has an edge profile 25.1, which, to be sure, also originates from a rectangular profile, where, however, a pair of diametrically opposed corner regions are each provided with an angular axial guide 51, 52 that extends the full length of the key. Vertical and horizontal guide surfaces in the correspondingly shaped keyway (not shown) of the associated cylinder core are assigned to each of these axial guides 51, 52. In the present case, only the other pair of corner regions then remains available for the previously described beveled coding 27.1 and 27.3. The different possible depths of cut 36.1 to 36.3 are also indicated in FIG. 1*b*, in the same way as in FIG. 6.

FIG. 1*b* also shows different possible increments 54.1 to 54.3 of the longitudinally profiled groove 28, similar to the aforementioned depths of cut 36.1 to 36.3 of the beveled codings 27.1, 27.3. These increments 54.1 to 54.3 produce the standard coding 53 that has already been mentioned several times and is also shown in FIG. 6.

LIST OF REFERENCE NUMBERS

10 lock cylinder
11 cylinder housing of 10
12 cylinder core of 10
13 standard tumbler of 10 (FIG. 10, FIG. 4)
14.1 first beveled tumbler (FIGS. 2*c*, 7)
14.2 second beveled tumbler (FIG. 8)
14.3 third beveled tumbler (FIG. 9)
15 keyway in 12
16 standard countercoding of 13 (FIGS. 4, 10)
17 distance between 27.1 and 27.2 (FIG. 6)
18 blocking channel in 11 for 13 (FIG. 4)
19 chamber for 13 in 12 (FIG. 4)
20.0 key according to the prior art (FIGS. 3, 4)
20.1 first embodiment of the key of the invention (FIGS. 1*a*, 1*b*)
20.2 second embodiment of the key of the invention (FIGS. 2*a* to 9)
21 first corner strip of 20.0 or 20.2 (FIG. 5)
22 second corner strip of 20.0 or 20.2 (FIG. 5)
23 third corner strip of 20.0 or 20.2 (FIG. 5)
24 fourth corner strip of 20.0 or 20.2 (FIG. 5)
25.0 edge profile of 20.0, rectangular profile (FIG. 3)
25.1 edge profile of 20.1, rectangular profile (FIGS. 1*a*, 1*b*)
25.2 edge profile of 20.2 (FIGS. 6 to 10)
26 standard coding of 20.0, 20.1 (FIG. 2*a*)
27.1 first beveled coding of 29.1 (FIGS. 6, 1*b*)
27.2 second beveled coding of 29.2 (FIG. 6)
27.3 third beveled coding of 29.3 (FIGS. 6, 1*b*)
27.4 fourth beveled coding of 29.4 (FIG. 6)
28 coding groove in 20.0 or 20.1
29.1 first bevel cut of 25.1 (FIG. 5)
29.2 second bevel cut of 25.1 (FIG. 5)
29.3 third bevel cut of 25.1 (FIG. 5)
29.4 fourth bevel cut of 25.1 (FIG. 5)
30 projection on 13 (FIG. 4)
31 first scanning direction of 21 to 24 (FIG. 5)
31' opposite direction of scanning of 14.13, 14.14 (FIGS. 7*b*, 7*c*)
32 second scanning direction of 21 to 24 (FIG. 5)
33 third scanning direction of 21 to 24 (FIG. 6)
34 fourth scanning direction of 21 to 24 (FIG. 6)
35 scanning direction of 13 (FIGS. 4, 5, 9, 10)
36.1 first depth of cut of 27.1 to 27.4 (FIG. 6)
36.2 second depth of cut of 27.1 to 27.4 (FIG. 6)
36.3 third depth of cut of 27.1 to 27.4 (FIG. 6)
37 lateral projection on 13, 14.1 (FIGS. 4, 7)
38 first broad side of 20.2, flat side (FIG. 6)
39 second broad side of 20.2, flat side (FIG. 6)

40.0 window in 13 (FIG. 10)
40.1 window in 14.1 (FIGS. 2*c*, 7)
40.12 window in 14.12 (FIG. 7*a*)
40.13 window in 14.13 (FIG. 7*b*)
40.14 window in 14.14 (FIG. 7*c*)
40.2 window in 14.2 (FIG. 8)
40.3 window in 14.3 (FIG. 9)
41 spring loading of 14.1 (FIG. 7)
41' spring loading of 14.13, 14.14 (FIGS. 7*b*, 7*c*)
42 spring loading of 14.2 (FIG. 8)
43 spring loading of 14.3 (FIG. 9)
44 positive guidance of 13 in 28 (FIGS. 5, 10)
45 spring at 13 (FIG. 4)
46 arrow of rotational movement of 12 (FIG. 4)
47.1 cooperating scanning point on 14.1 for 21 (FIG. 7)
47.2 cooperating scanning point on 14.1 for 22 (FIG. 7*a*)
47.3 cooperating scanning point on 14.1 for 23 (FIG. 7*b*)
47.4 cooperating scanning point on 14.1 for 24 (FIG. 7*c*)
48 angle between 33, 35 (FIG. 9)
49 vertical guide surface for 51, 52 (FIG. 1*b*)
50 horizontal guide surface for 51, 52 (FIG. 1*b*)
51 first angular axial guide (FIG. 1*b*)
52 second angular axial guide (FIG. 1*b*)
53 standard coding of 28 (FIGS. 1*b*, 6)
54.1 first increment in 53 (FIG. 1*b*)
54.2 second increment in 53 (FIG. 1*b*)
54.3 third increment in 53 (FIG. 1*b*)

The invention claimed is:

1. A lock device with a lock cylinder (10), which comprises a stationary cylinder housing (11) and a cylinder core (12) rotatably supported therein, with a key (20.1, 20.2), which has an edge profile (25.1, 25.2) and can be inserted into an axial keyway (15) of the cylinder core (12), with platelet-shaped tumblers (13, 14.1 to 14.3), which already engage in a locking channel (18) of the cylinder housing (11) via a spring force (41-43) when the key (20.1, 20.2) is not inserted, and which are movable transversely to the keyway (15) when the key (20.1, 20.2) is inserted, and sorted against the cross section of the cylinder core (12) by the spring force (41-43), with at least one longitudinally profiled shoulder (28) on a flat side (38; 39) of the edge profile (25.1) of the key (20.1, 20.2), which shoulder (28) extends in the longitudinal direction and produces different scanning points of a standard coding (26, 53) on the key (20.1; 20.2) by virtue of the course of its profile, and with a cooperating shoulder (30) on at least some tumblers (13), which then act as standard tumblers (13), where, when the key (20.1; 20.2) is inserted, the cooperating shoulders (30) of all the standard tumblers (13) are supported on the longitudinally profiled shoulder (28) of the key and produce a standard counter coding (16) that is complementary to the standard coding (26, 53) of the key (20.1; 20.2), wherein, in addition to the standard coding (26), the key (20.1; 20.2) has beveled codings (27.1 to 27.4) in corner regions of its edge profile (25.1, 25.2), because bevel cuts (29.1 to 29.4) of variable depth (36.1 to 36.3) are cut into the corner regions of its edge profile (25.1, 25.2), thus forming profiled corner strips (21 to 24), which extend in the longitudinal direction of the key and carry the beveled codings (27.1 to 27.4);

where an oblique cooperating scanning point (47.1 to 47.4) in one of the tumblers (14.1 to 14.3) is associated with at least one scan point in the beveled codings (27.1 to 27.4) of the key 20.1; 20.2), which tumbler then interacts as a beveled tumbler (14.1 to 14.3) with the inserted key (20.1; 20.2); and where oblique cooperating scanning points (47.1 to 47.4) on a family of beveled tumblers (14.1 to 14.3), which are located together in the cylinder core (12), produce a beveled countercoding in the lock device (10).

2. A lock device according to claim 1, wherein the profiled shoulder of the standard coding comprises one of the edges of a profiled groove (28), which extends in the longitudinal direction of the key and is cut into at least one broad side (38, 39) of the key (20.1; 20.2).

3. A lock device according to claim 2, wherein the cooperating shoulder of each of the standard tumblers comprises one of the flanks of a projection (30), which, when the key (20.1; 20.2) is inserted, acts on a well-defined scanning point in the key groove (28).

4. A lock device according to claim 1, wherein a scanning direction (31) of the beveled tumbler (14.1) is oriented essentially parallel to the scanning direction (35) of the standard tumblers (13).

5. A lock device according to claim 1, wherein a scanning direction (32) of the beveled tumbler (14.2) is oriented essentially perpendicularly to the scanning direction (35) of the standard tumblers (13).

6. A lock device according to claim 1, wherein a scanning direction (33, 34) of the beveled tumbler (14.3) is oriented at an angle (48) to the scanning direction (35) of the standard tumblers (13).

7. A lock device according to claim 6, wherein the angle (48) of the scanning direction (33, 34) is 30-50°.

8. A lock device according to claim 1, wherein several corner strips (21 to 24) of the edge profile (25.1) of the key (20.1, 20.2) are provided with a beveled coding (27.1 to 27.4).

9. A lock device according to claim 8, wherein all of the corner strips (21 to 24) of the edge profile (20.1) of the key (20.1, 20.2) are provided with a beveled coding (27.1 to 27.4).

10. A lock device according to claim 8, wherein the beveled codings (27.1 to 27.4) of the various corner strips (21 to 24) of the key (20.1, 20.2) are designed to be the same as or different from one another.

11. A lock device according to claim 1, wherein a scanning direction (31 to 34) of successive beveled tumblers (14.1 to 14.3) alternates among essentially parallel (31), perpendicular (32), and at an oblique angle (33, 34) to the scanning direction (35) of the standard tumblers (13).

12. A lock device according to claim 11, wherein, to increase the range of variation of the codings, a standard tumbler (13) or a beveled tumbler (14.1 to 14.3), with a scanning direction (31 to 34) of its beveled counter coding (27.1 to 27.4), is placed at a given scanning point of the key (20.1, 20.2).

13. A lock device according to claim 1, wherein each standard tumbler (13) or the beveled tumbler (14.1 to 14.3) is spring-loaded in its scanning direction (31 to 35) by a spring.

14. A lock device according to claim 1, wherein a pair of beveled codings (27.1 and 27.3 or 27.2 and 27.4), which are located on opposite corner strips (21 and 23 or 22 and 24) in the edge profile (25.1) of the key (20.1, 20.2), are matched and serve the purpose of positive guidance of a beveled tumbler common to the beveled codings of the pair, and the common beveled tumbler has a matching pair of cooperating scanning points for the pair of beveled codings (27.1 and 27.3 or 27.2 and 27.4) at this scanning point of the key (20.1, 20.2).

15. A lock device in accordance with claim 1, wherein the beveled codings (27.1 to 27.4) of the key (20.1, 20.2) is different from the standard coding (26).

16. A lock device according to claim 1, wherein the bevel cuts (27.1, 27.2) of adjacent beveled codings (27.1, 27.2) of the key (20.2) do not overlap each other but rather are separated by a lateral distance (17), and in that a certain section of the edge profile (25.2) of the key (20.2) remains where this lateral distance (17) is present can thus serve the purpose of guiding the key (20.2) in the keyway (15) of the cylinder core (12).

17. A lock device according to claim 1, wherein the edge profile (15.2) of the key (20.1, 20.2) is a rectangle.

18. A lock device according to claim 17, wherein the rectangular key (25.2) is designed as a flat key with opposing broad faces (38, 39).

* * * * *